US007322792B2

(12) United States Patent
Liu

(10) Patent No.: US 7,322,792 B2
(45) Date of Patent: Jan. 29, 2008

(54) COOLING FAN WITHOUT RETURNING FLOW

(75) Inventor: Wen-Hao Liu, Taipei (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 0 days.

(21) Appl. No.: 10/959,970

(22) Filed: Oct. 8, 2004

(65) Prior Publication Data

US 2006/0078425 A1 Apr. 13, 2006

(51) Int. Cl.
*F04D 29/38* (2006.01)

(52) U.S. Cl. ..... 415/199.4; 415/219.1; 415/220; 416/175; 416/200 R; 416/201 A; 416/203

(58) Field of Classification Search ..... 415/66, 415/68, 69, 199.4, 218.1, 219.1, 220, 222, 415/223; 416/170 R, 175, 183, 188, 198 R, 416/200 R, 201 A, 203, 201 R; 417/366, 417/423.1, 423.14; 310/58, 62, 63, 67 R, 310/90

See application file for complete search history.

(56) References Cited

U.S. PATENT DOCUMENTS 4,482,302 A * 11/1984 Grignon ..... 415/220
6,916,160 B2 * 7/2005 Obara ..... 417/423.14
2006/0045776 A1 * 3/2006 Kalavsky ..... 417/423.14

FOREIGN PATENT DOCUMENTS

WO WO-2004/044434 A1 * 5/2005

* cited by examiner

*Primary Examiner*—Christopher Verdier

(57) ABSTRACT

A cooling fan without returning flow comprises a motor stator, a frame and a motor rotor. The frame is joined to the stator with a support device at the inlet side thereof. The motor rotor is disposed at the stator. A fan blade set is disposed under the rotor and at the outlet side of the frame. An airflow area of the outlet can be increased to prevent the outlet side from producing a stagnation zone so as to increase cooling area and reduce noise.

13 Claims, 16 Drawing Sheets

FIG 1 (PRIOR ART)
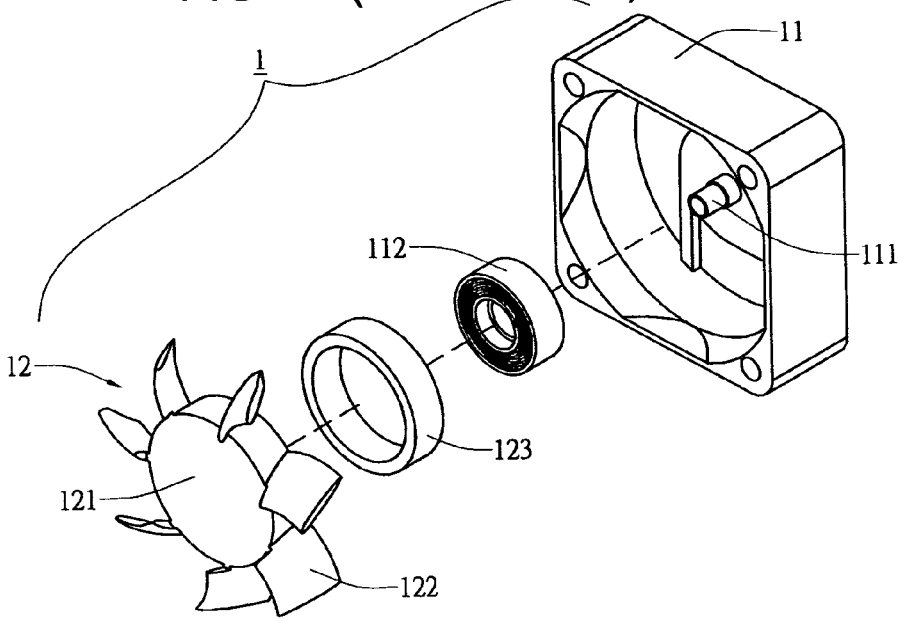
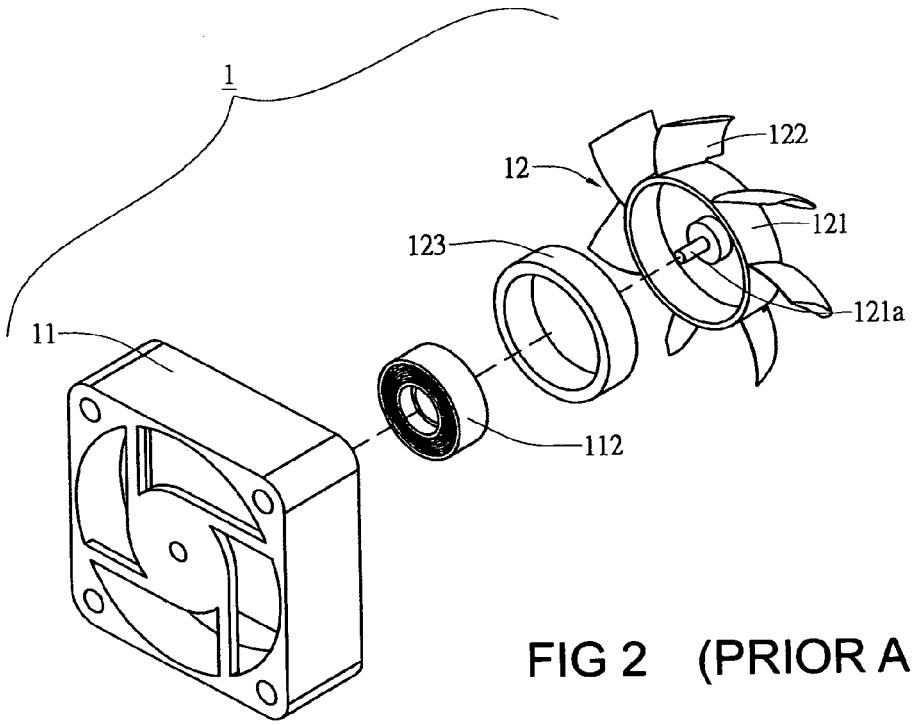
FIG 2 (PRIOR ART)

FIG 5 (PRIOR ART)
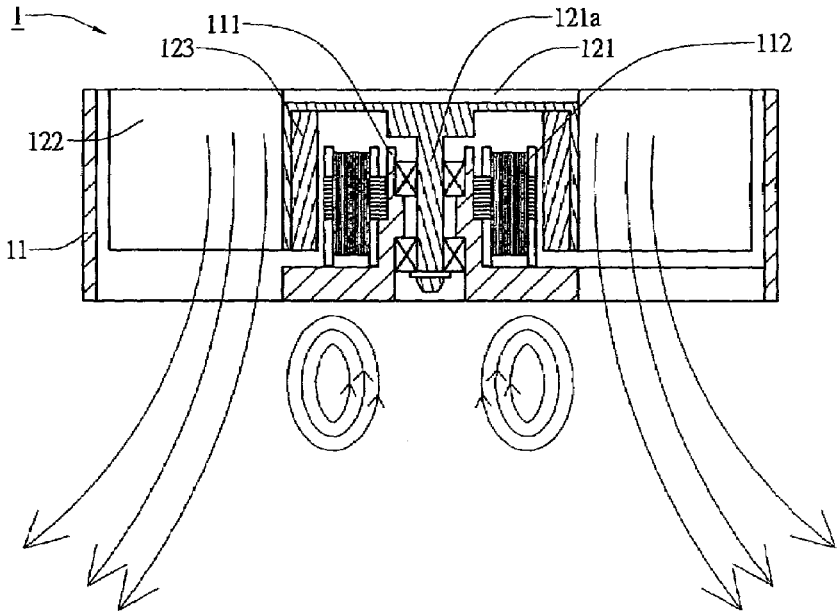
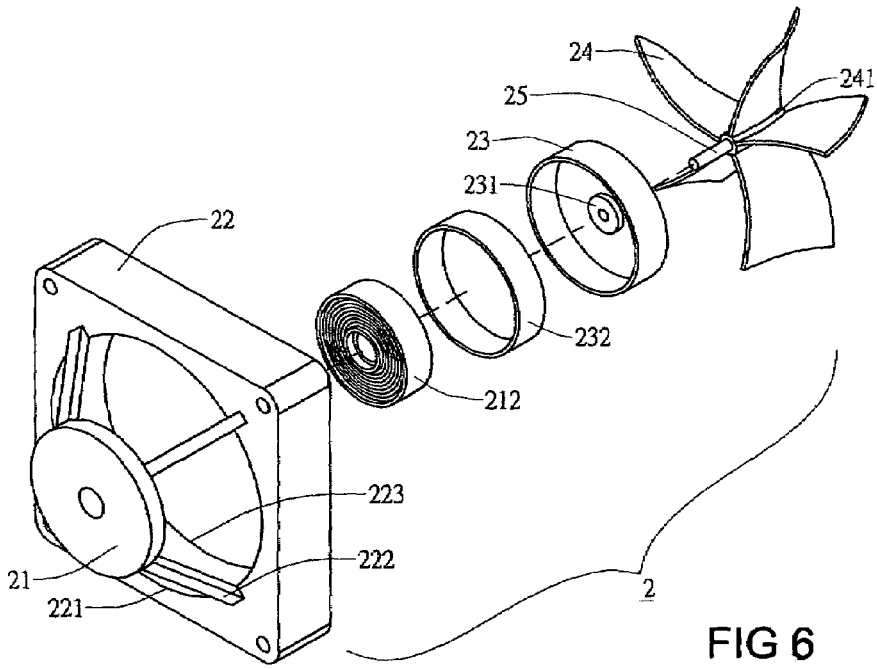
FIG 6

FIG 7
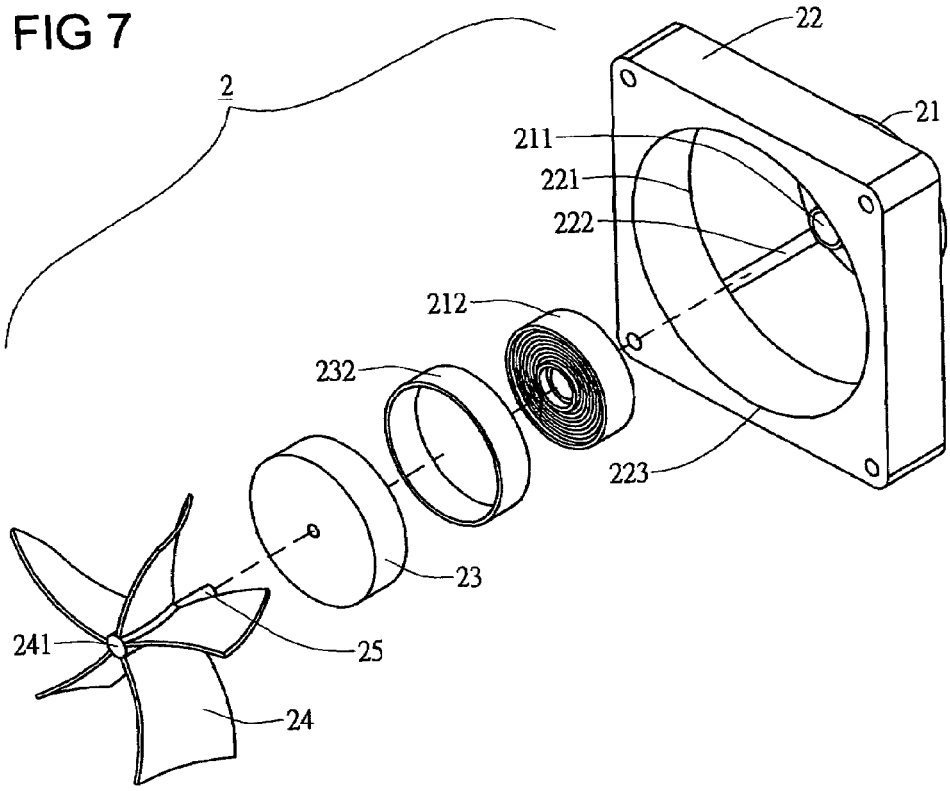
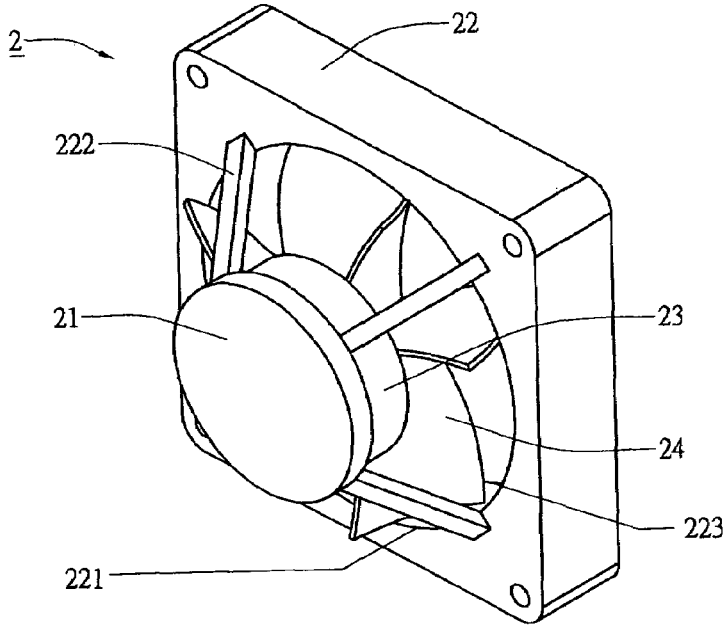
FIG 8

FIG 9
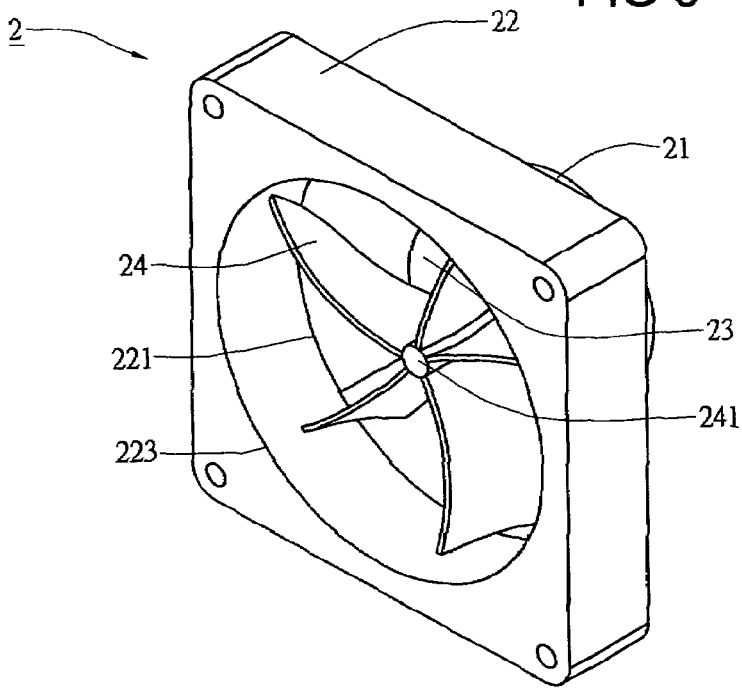
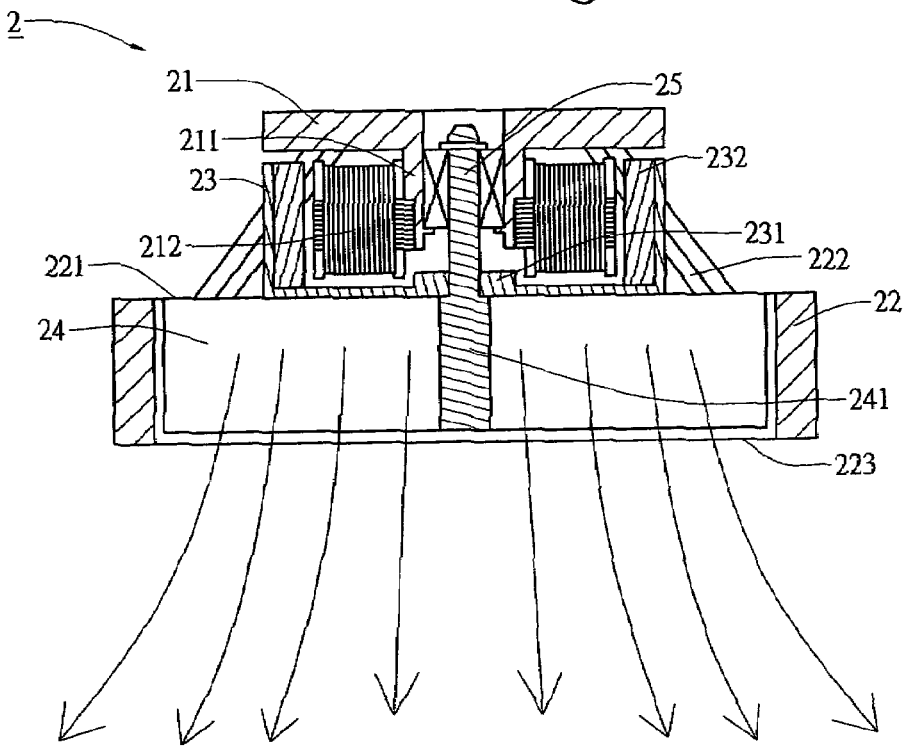
FIG 10

FIG 11
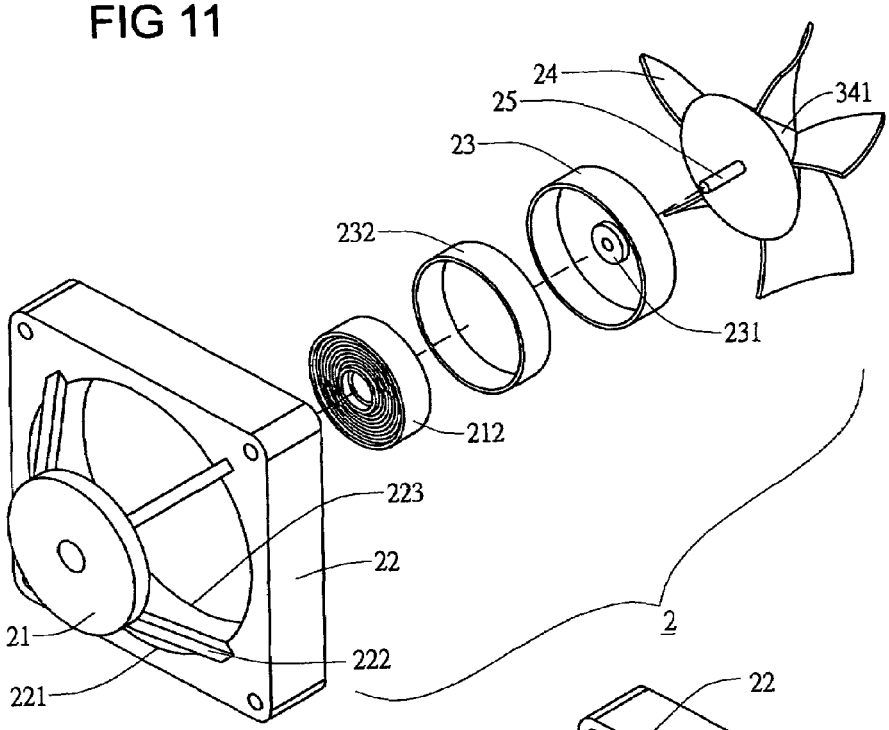
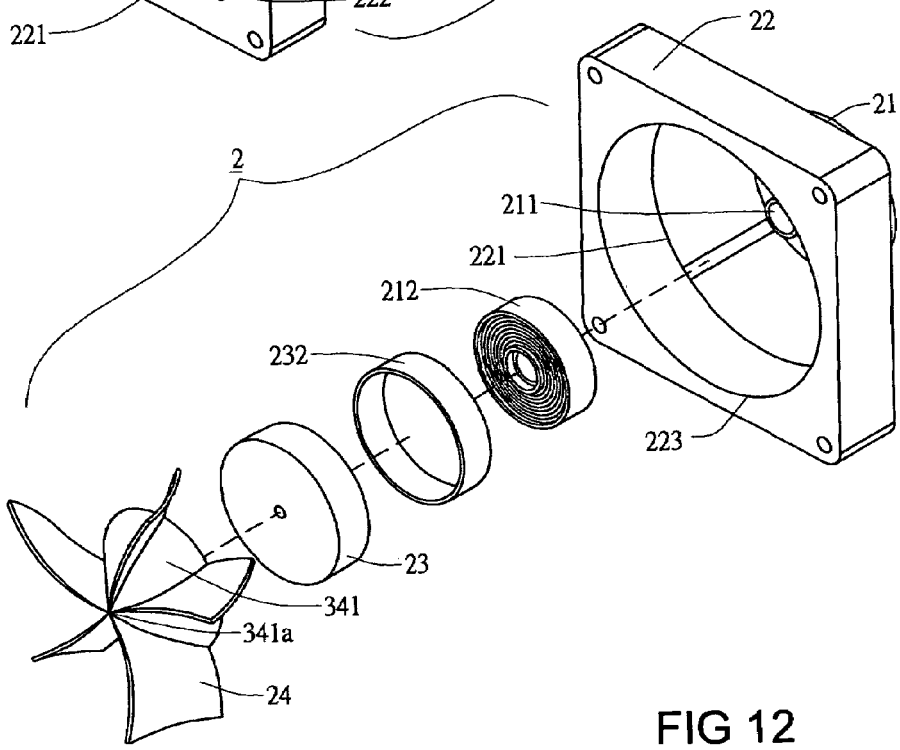
FIG 12

FIG 13
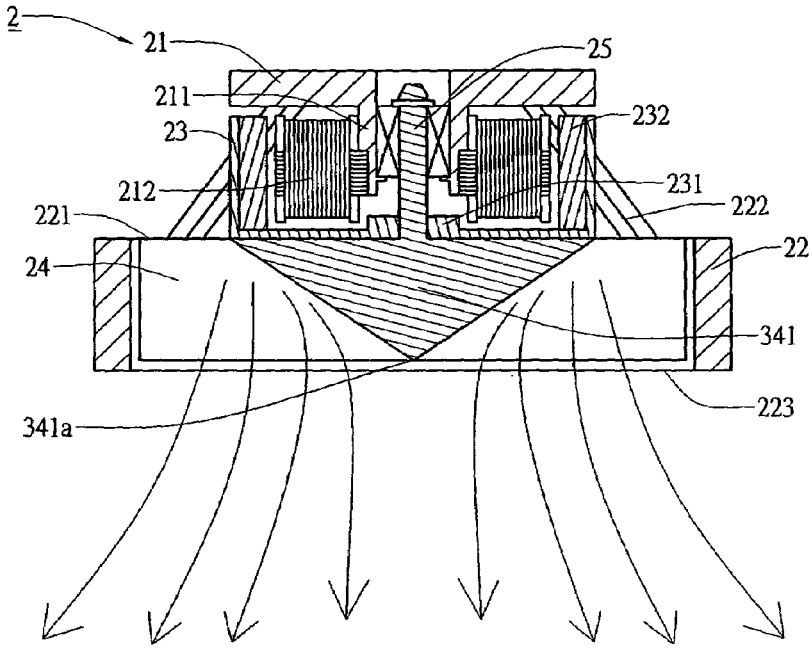
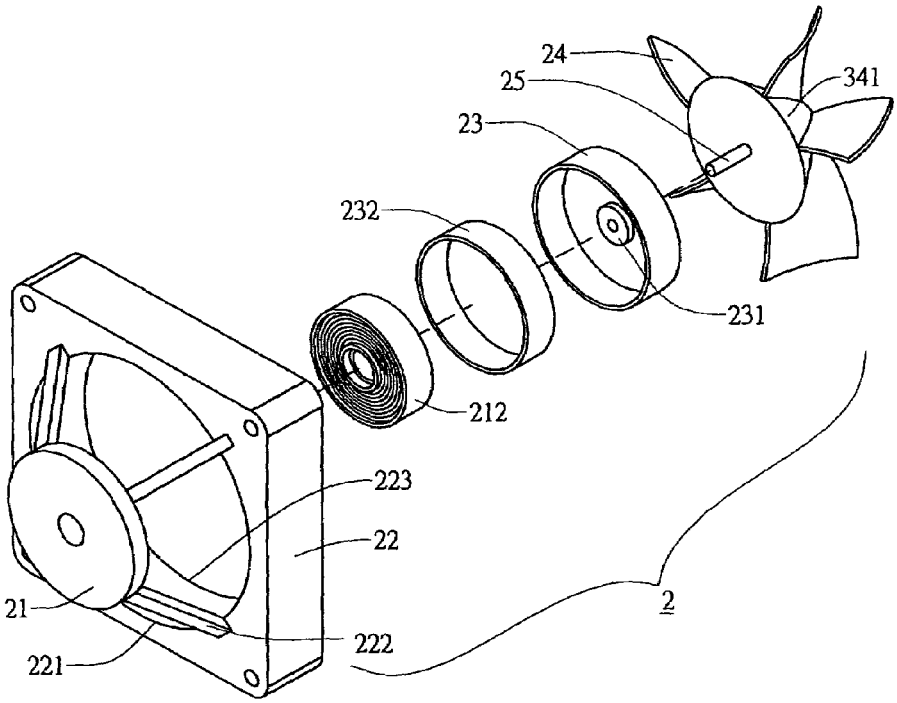
FIG 14

FIG 15
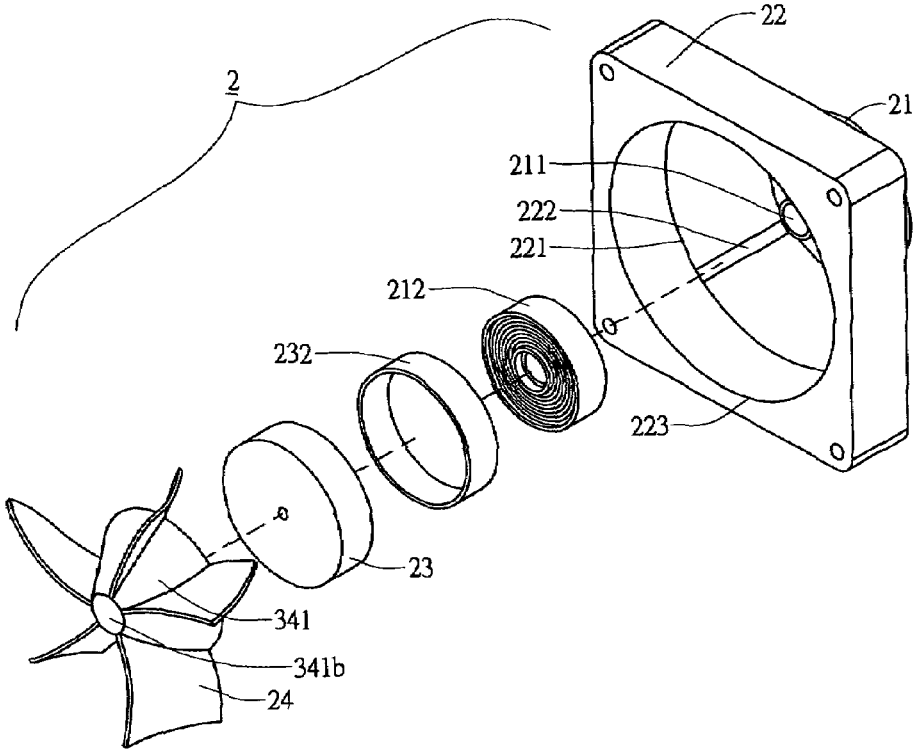
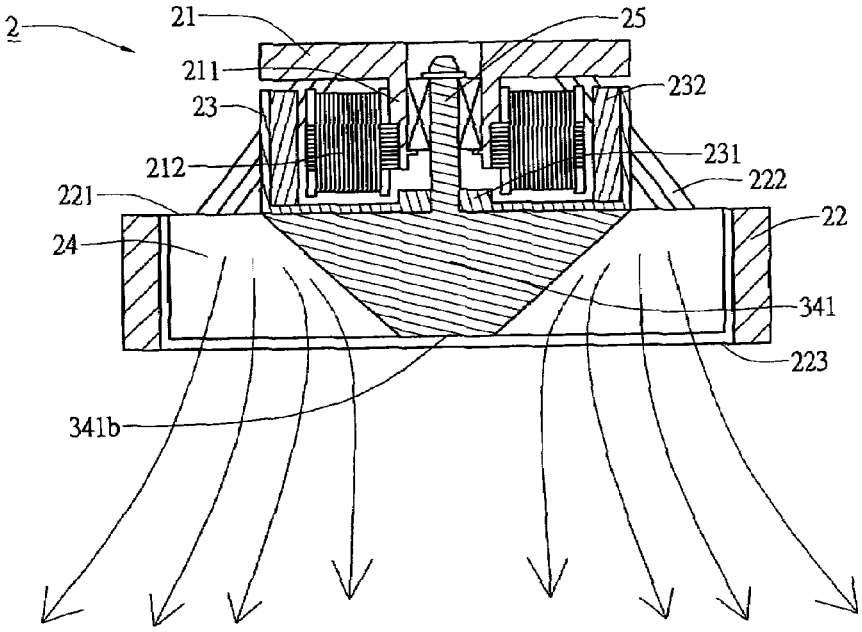
FIG 16

FIG 17
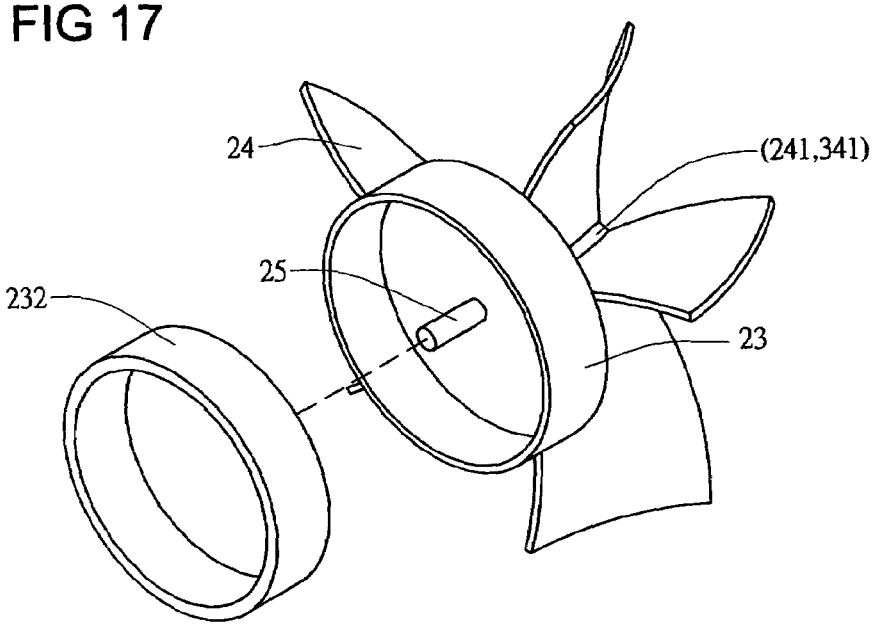
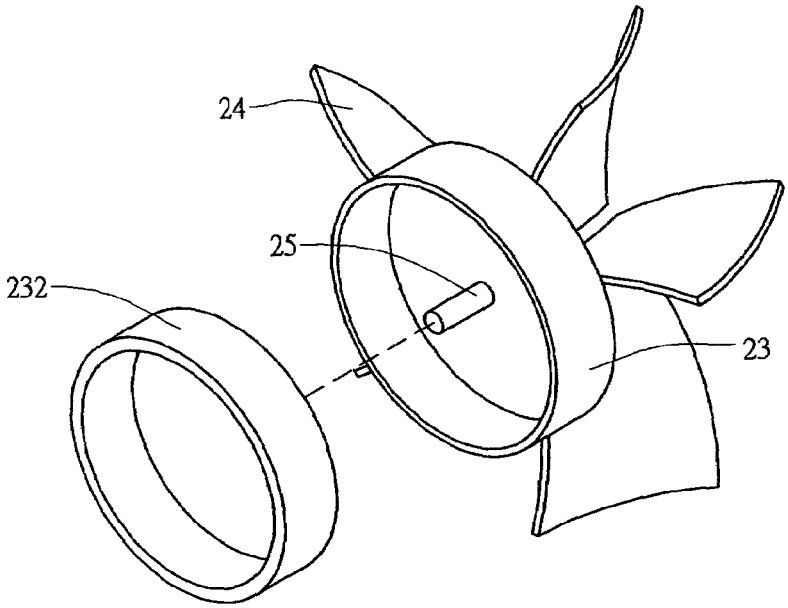
FIG 18

FIG 19
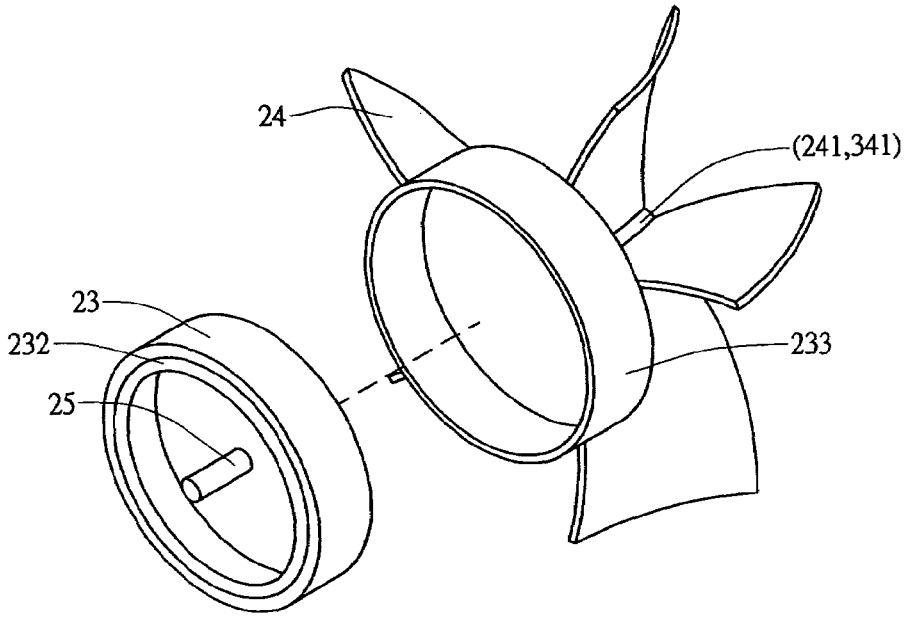
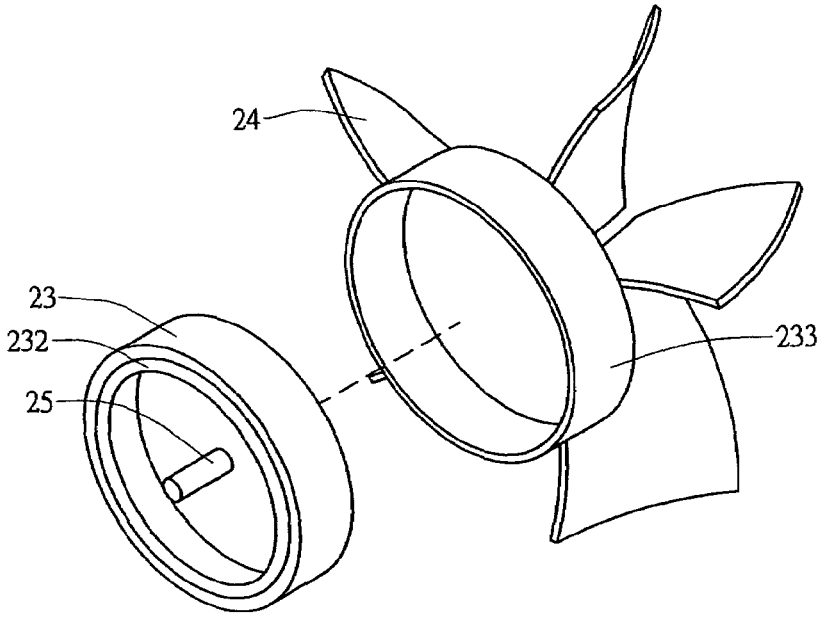
FIG 20

FIG 25
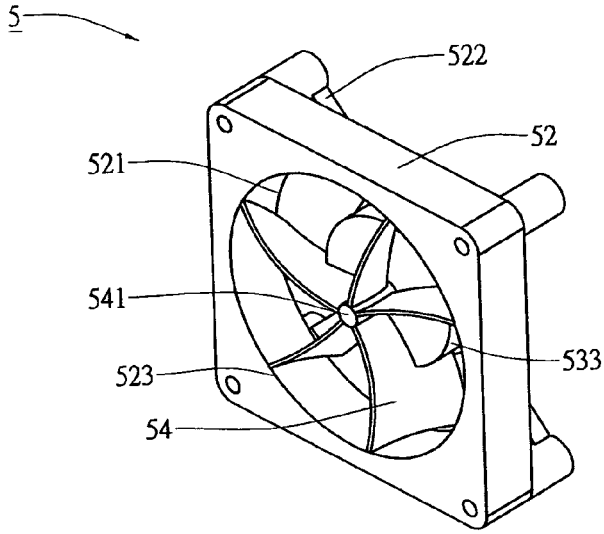
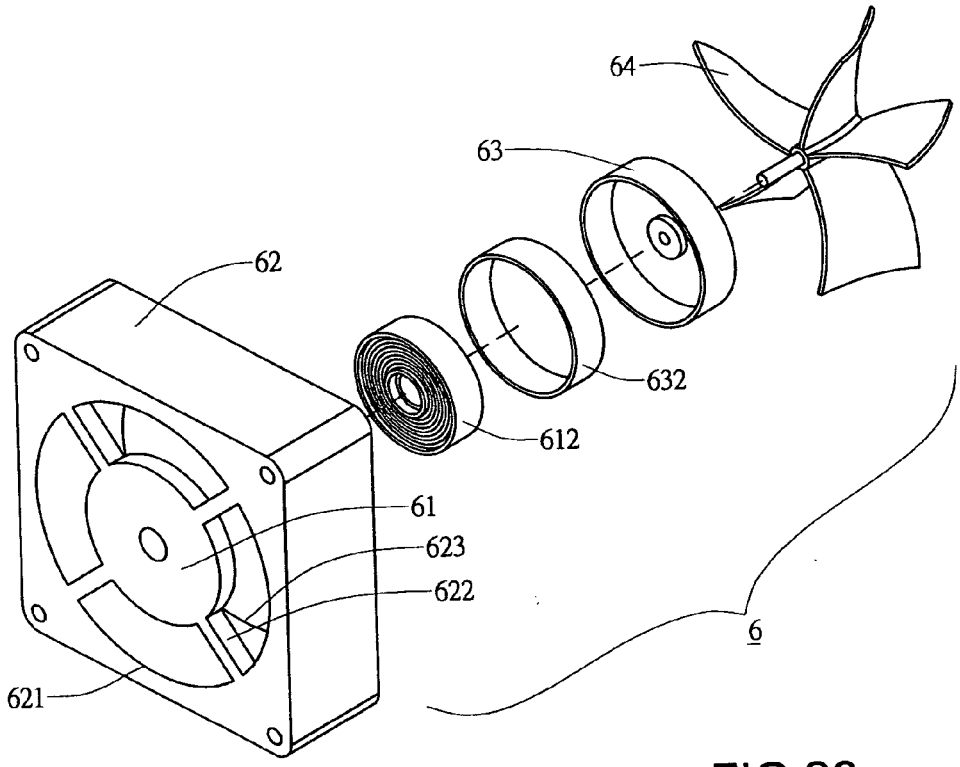
FIG 26

FIG 27
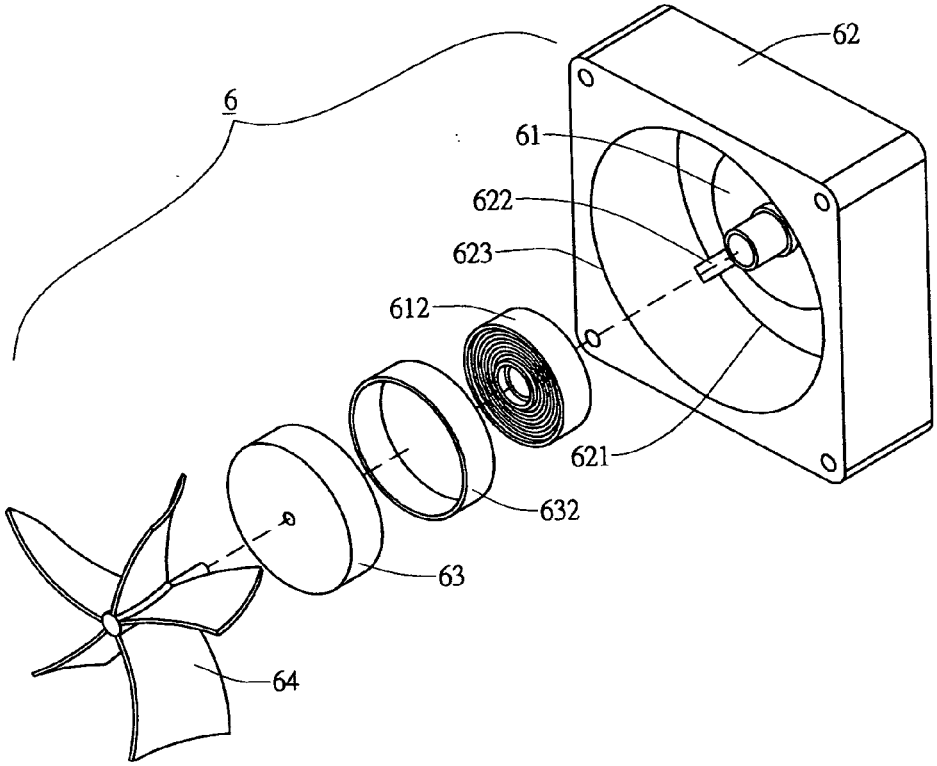
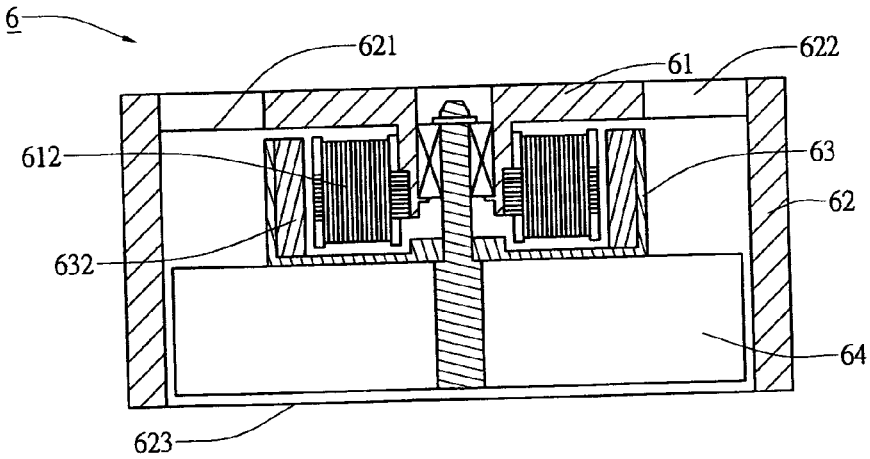
FIG 28

COOLING FAN WITHOUT RETURNING FLOW

BACKGROUND OF THE INVENTION

1. Field of the Invention

The present invention is related to a cooing fan without returning flow and particularly to a cooling fan, with which airflow at the outlet can be increased largely without producing a stagnation zone for expanding cooling area and attenuating noise.

2. Brief Description of the Related Art

Due to electronic components being developed rapidly to increase their running speeds, much more heat is generated from the electronic components too. Thus, how to dissipate heat properly for the electronic components being capable of running smoothly is an important subject that has to be faced by designers of the electric components.

Referring to FIGS. 1 to 4, the conventional cooling fan 1 includes a motor stator 11 and a motor rotor 12. The stator 11 has a bearing sleeve 111 and the bearing sleeve 111 is surrounded with a coil 112. The hub 121 of the rotor 12 is attached with a fan blade set 122. The hub 121, which has a shaft 121*a* and a magnet 123, is placed inside the hub 121. After the rotor 12 is mounted to the stator 11, the motor 12 can rotate by way of the coil 112 and the magnet 123 acting with each other. Referring to FIG. 5, when the cooling fan runs, the airflow generated from the fan blade set 122 can form an airflow stagnation zone behind the hub 121 and it results in the airflow being unable to move smoothly. Thus, the overall effect of heat dissipation of the cooling fan is influenced significantly.

SUMMARY OF THE INVENTION

An object of the present invention is to provide a cooling fan without returning flow with which airflow area at the outlet side thereof can be increased effectively.

Another object of the present invention is to provide a cooling fan without returning flow with which no stagnation zone is produced at the outlet of the fan.

A further object of the present invention is to provide a cooling fan without returning flow with which low sound level of noise is created.

BRIEF DESCRIPTION OF THE DRAWINGS

The detail structure, the applied principle, the function and the effectiveness of the present invention can be more fully understood with reference to the following description and accompanying drawings, in which:

FIG. 1 is an exploded perspective view of the conventional cooling fan;

FIG. 2 is another exploded perspective view of the conventional cooling fan;

FIG. 5 is a sectional view of the conventional cooling fan;

FIG. 6 is an exploded perspective view of the first embodiment of a cooling fan according to the present invention;

FIG. 7 is another exploded perspective view of the first embodiment of a cooling fan according to the present invention;

FIG. 8 is an assembled perspective view of the first embodiment of a cooling fan according to the present invention;

FIG. 9 is another assembled perspective view of the first embodiment of a cooling fan according to the present invention;

FIG. 10 is a sectional view of the first embodiment of a cooling fan according to the present invention;

FIG. 11 is an exploded perspective view illustrating the first embodiment of the present invention providing another central part different from that shown in FIGS. 6 and 7;

FIG. 12 is an assembled perspective view of FIG. 11;

FIG. 13 is a sectional view of FIG. 11;

FIG. 14 is an exploded perspective view illustrating the first embodiment of the invention providing a further central part;

FIG. 15 is an assembled perspective view of FIG. 14;

FIG. 16 is a sectional view of FIG. 14;

FIG. 17 is a perspective view illustrating another type of the fan blades being mounted to the rotor of the motor in the first embodiment of the present invention;

FIG. 18 is an exploded perspective view illustrating the fan blades being before mounting with the rotor of motor shown in FIG. 17;

FIG. 19 is a perspective view illustrating a further type of the fan blades being mounted to the rotor of the motor in the first embodiment of the present invention;

FIG. 20 is an exploded perspective view illustrating the fan blades being before mounting with the rotor of the motor shown in FIG. 19;

FIG. 25 is another assembled perspective view of the second embodiment of a cooling fan according to the present invention;

FIG. 26 is an exploded perspective view of the third embodiment of a cooling fan according to the present invention;

FIG. 27 is another exploded perspective view of the third embodiment of a cooling fan according to the present invention;

FIG. 28 is a sectional view of the third embodiment of a cooling fan according to the present invention;

DETAILED DESCRIPTION OF THE INVENTION

Figure 3:
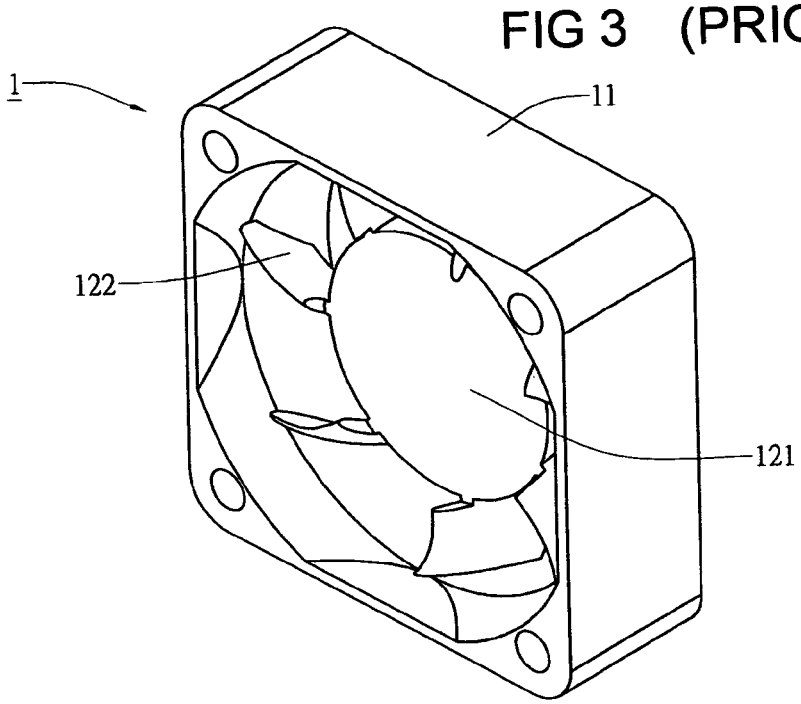
FIG 3 (PRIOR ART)
FIG. 3 is an assembled perspective view of the conventional cooling fan.
Figure 4:
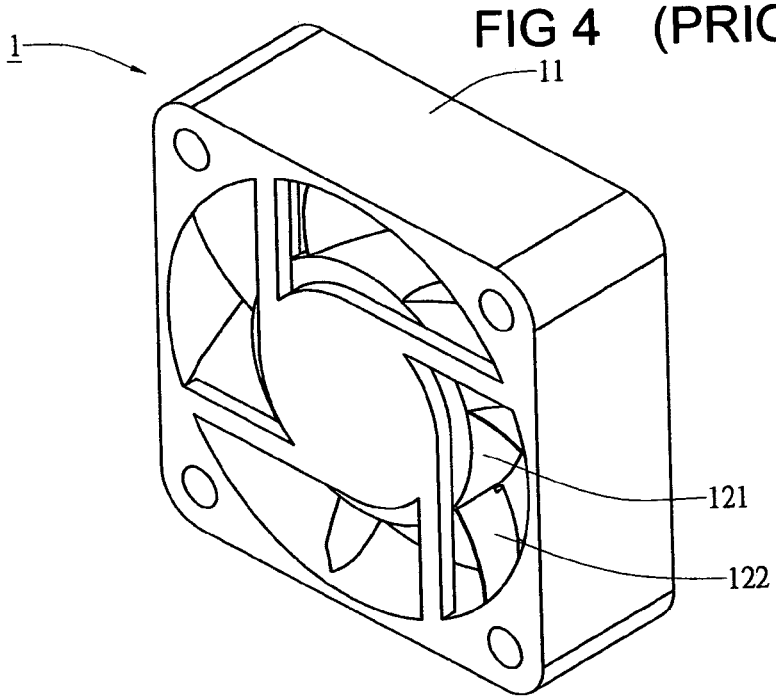
FIG 4 (PRIOR ART)
FIG. 4 is another assembled perspective view of the conventional cooling fan.

Referring to FIGS. 6 to 9, the first embodiment of the present invention is illustrated and it can be seen that the cooling fan 2 comprises a motor stator 21, a frame 22, a motor rotor 23 and a fan blade set 24. The frame 22 has a circular hollow space with a facial side and a back side for accommodating the fan blade set 24. The back side is the side of an air inlet 221 and the facial side is the side of an air outlet 223. The stator 21 is a disk and provides a bearing sleeve 211 at the center thereof and a coil 211 is disposed to surround the bearing sleeve 211. The stator 21 is attached to the side of the air inlet 221 with a support device 222, which is composed of a plurality of including radial bars with both ends of the respective radial bar fixedly attached to the frame 22 at the side of the inlet 221 and the circumferential side of the stator 21. Hence, the stator 21 is positioned in front of the side of the inlet 221 with a space between the stator 21 and the side of the inlet 221. The rotor 23 is circular and has a channel shaped cross section with a circumferential wall, an open side and a closed side. The open side of the rotor 23 faces the stator 21 and the closed side of the rotor 23 has a central joining part 231 with an axial fitting hole. Further, the rotor 23 has a receiving space to receive the bearing sleeve 211 and the coil 212 and the inner side of the circumferential wall of the rotor 23 is attached with a ring shaped magnet 232. The fan blade set 24 is radially attached to a stem shaped central part 241 and the closed side of the rotor 23 laterally. An end of the central part 241 extends a shaft section 25, which has a diameter corresponding to the fitting hole of the joining part 231 of the rotor 23.

The shaft section 25 passes through the fitting hole of the joining part 231 and inserts into the bearing sleeve 211 to fit with a bearing inside the bearing sleeve 211 and tightly fits with the fitting hole of the joining part 231 at the joint of the central part 241 and the shaft section 25. In this way, the rotor 23 with the fan blade set 24 is rotatably joined to the bearing sleeve 211 of the stator 21.

Referring to FIG. 10, when the cooling fan 2 is powered on, smooth air flow can move outward via the outlet 223 completely without causing a stagnation zone at the central area of outlet 223. Hence, the deficiency of a stagnation zone at the outlet 223 being caused by the hub in the conventional fan can be avoided and noise of the cooling fan can be attenuated effectively.

Referring to FIGS. 11 to 13, the central part 341 of the fan blade set 24 can be a shape of a cone instead of a stem and the tip 341*a* of the central part 341 is disposed at the side of the outlet 223 to facilitate air flowing and enhance the effect of heat dissipation. Referring to FIGS. 14 to 16, the central part 341 can be made with a shape of truncated cone and the flat top 341*b* of the central part 341 is disposed at the side of the outlet 223.

Figure 21:
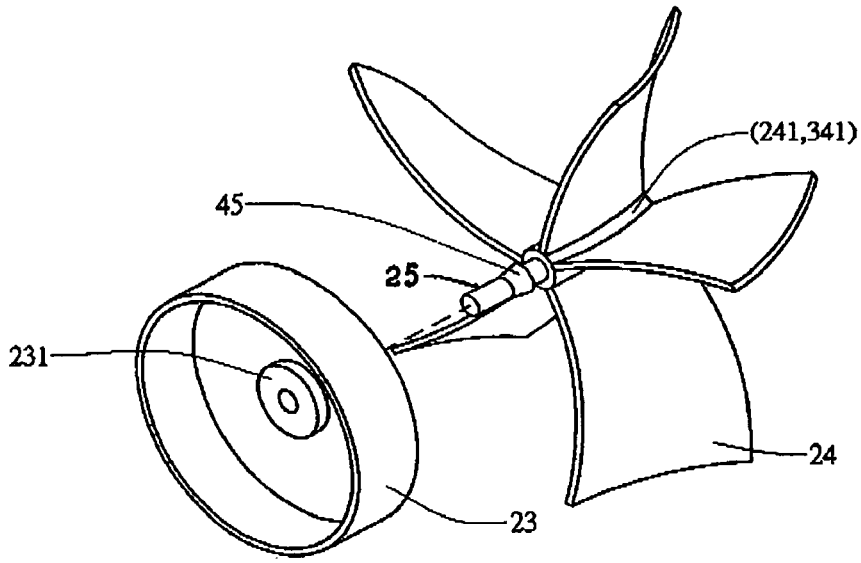
FIG. 21 is a perspective view illustrating a further type of the fan blades being mounted to the rotor of the motor in the first embodiment of the present invention.
Figure 22:
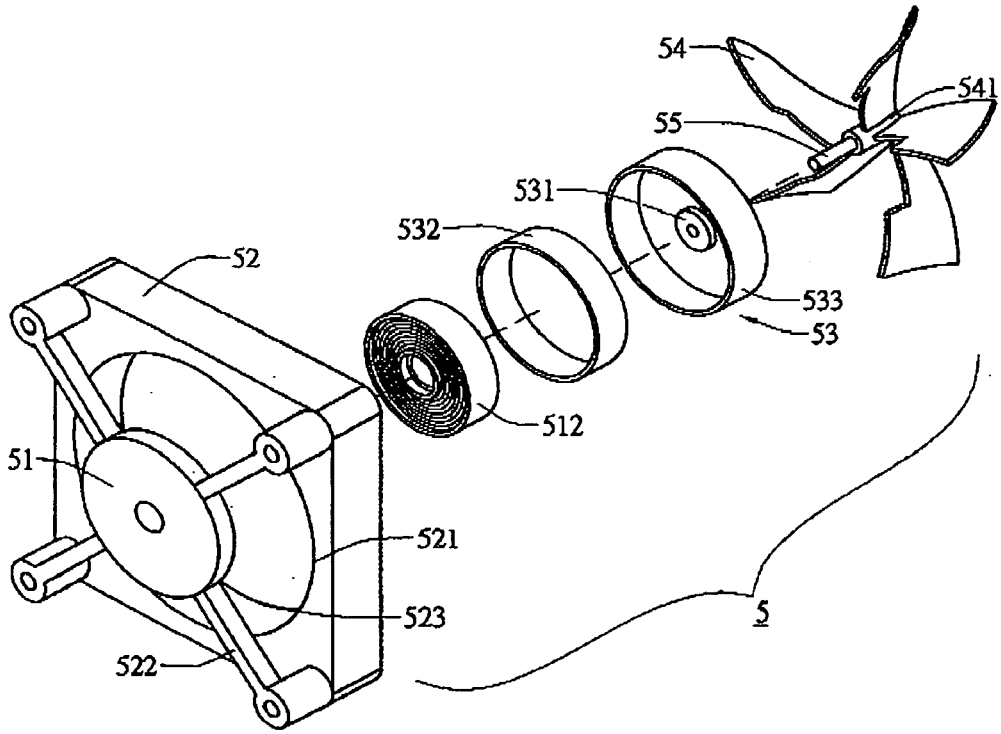
FIG. 22 is an exploded perspective view of the second embodiment of a cooling fan according to the present invention.
Figure 23:
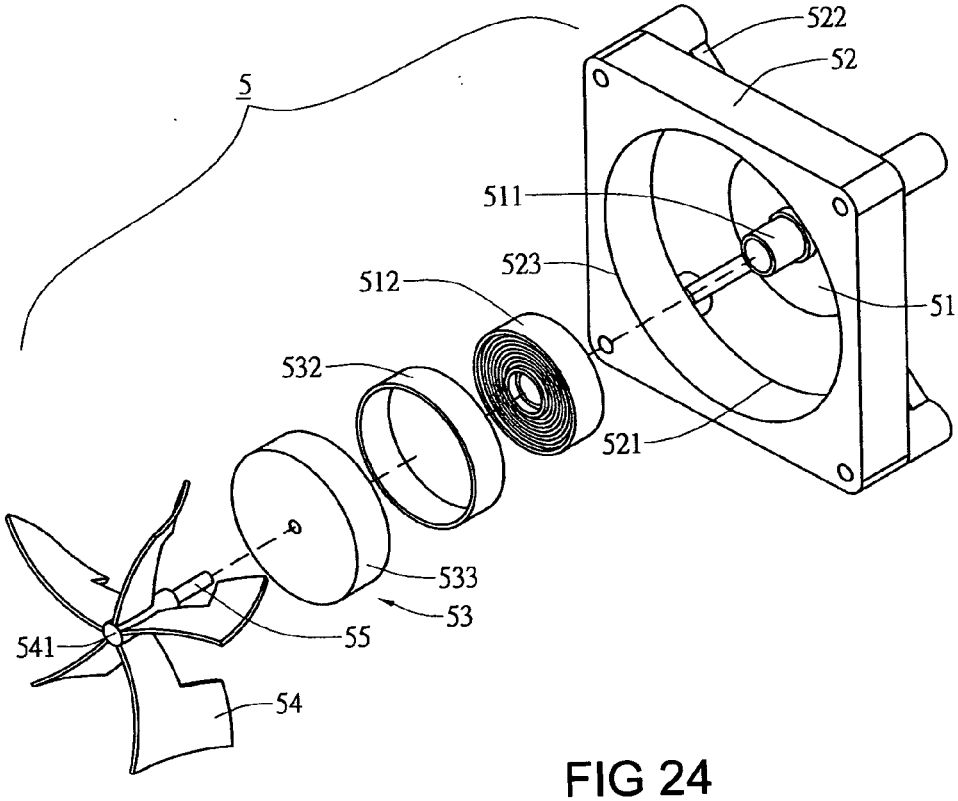
FIG. 23 is another exploded perspective view of the second embodiment of a cooling fan according to the present invention.
Figure 24:
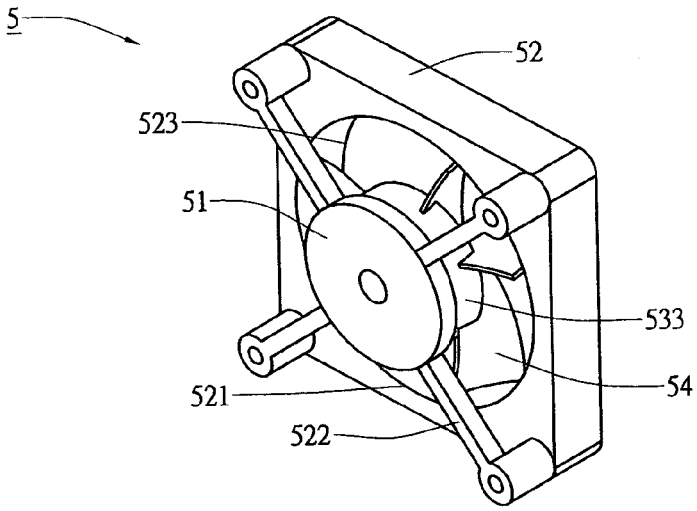
FIG. 24 is an assembled perspective view of the second embodiment of a cooling fan according to the present invention.

Referring to FIG. 17, in addition to the fan blade set 24 being joined to the central part (241, 341), the shaft section 25 is integrally joined to the rotor 23. FIG. 18 shows no central part (241, 341) is provided and the fan blade set 24 is integrally joined to the outer side of the circumferential wall of the rotor 23 and the shaft section 25 is integrally joined to the rotor 23 too. Then, the magnet 232 shown in FIGS. 17 and 18 is attached to the rotor 23. Further, referring to FIG. 19, the fan blade set 24 is joined to the central part (241, 341) and integrally joined to the outer surface of an annular member 233. The shaft section 25 and the magnet 232 are attached to the rotor 23 and then the annular member 233 is attached to the rotor 23. Referring to FIG. 20, the fan blade set 24 is made integrally with the annular member 233 directly instead of being joined to the central part 241, 341 shown in FIG. 19. Moreover, referring to FIG. 21, a suitable taper secure piece 45 can be arranged on the shaft section 325 of the central part (241, 341) to allow the fan bald set 24 being secured to the joining part 231 of the rotor 23 properly.

Referring to FIGS. 22 to 25, the second embodiment of the present invention is illustrated. The bearing sleeve 511 in the stator 51 of the cooling fan 5 is attached with a coil 512 and the frame 52 at the side of the inlet 521 is provided with a support device 522, which has four radial bars extending to the four corners of the frame 52 respectively in a way of being parallel to the side of the inlet for the stator 51 being able to be joined to the side of the inlet 521. It can be seen in FIG. 24 that each of the radial bars is fixedly attached to the circumferential side of the stator 51 at an end thereof and another end of the respective radial perpendicularly extends an engaging post with a fixing hole corresponding to one of the four corners of the frame 52. Hence, the stator 51 is capable of being disposed in front of the side of the inlet 522 with a space between the stator 51 and the side of the inlet 522. The rotor 53 has a central joining part 531 with an axial fitting hole and the inner side of the circumferential wall of the rotor is attached with a magnet 532. The fan blade set 54 is attached to a central part 541 and the central part 541 is configured as a stem and extends a shaft section 55. The fan blades of the fan blade set 54 extend to the outer side of the circumferential wall 533 of the rotor 53. The shaft section 55 passes through the fitting hole of the joining part 531 of the rotor 53 and inserts into the bearing sleeve 511 to rotatably fit with a bearing in the bearing sleeve 51. In addition, the shaft section 55 tightly fits with the joining part 531 at the joint to the central part 541. In this way, the rotor 53 is capable of being disposed at the space between the stator 51 and the side of the inlet 522 and the fan blade set 54 is received in the hollow space of the frame 52.

When the cooling fan 5 is powered on, airflow can move outward via the outlet 523 smoothly without any obstacles. Hence, the disadvantage of producing stagnation zone at the center of the side of outlet 523 can be avoided and less noise can be produced from the fan.

Referring to FIGS. 26 to 28, the third embodiment of the present invention is illustrated. The stator 61 of the cooling fan 6 is disposed at the center of the inlet 621 and joined to the frame 62 with a support device 622 in a way of four radial bars of the support device 622 joined to the circumferential side of the stator 61 at an end thereof and joined to the circumferential surface of the circular hollow space in the frame. A coil 612 being arranged to surround the bearing sleeve of the stator 61, a fan blade set 64 with a central part, which extends a shaft section to pass through a rotor 63 and inserts into the bearing sleeve to fit with a bearing, and being fixedly attached to the rotor 63 are the same as the preceding embodiments. The difference of the present embodiment is in that the stator 61, the rotor 63 and the fan blade set 64 are received in the circular hollow space of the frame 62. Similarly, the airflow moves outward via the outlet 623 smoothly without any obstacles. Further, another advantage of the present embodiment is that the entire volume of the fan 6 is reduced substantially.

Figure 29:
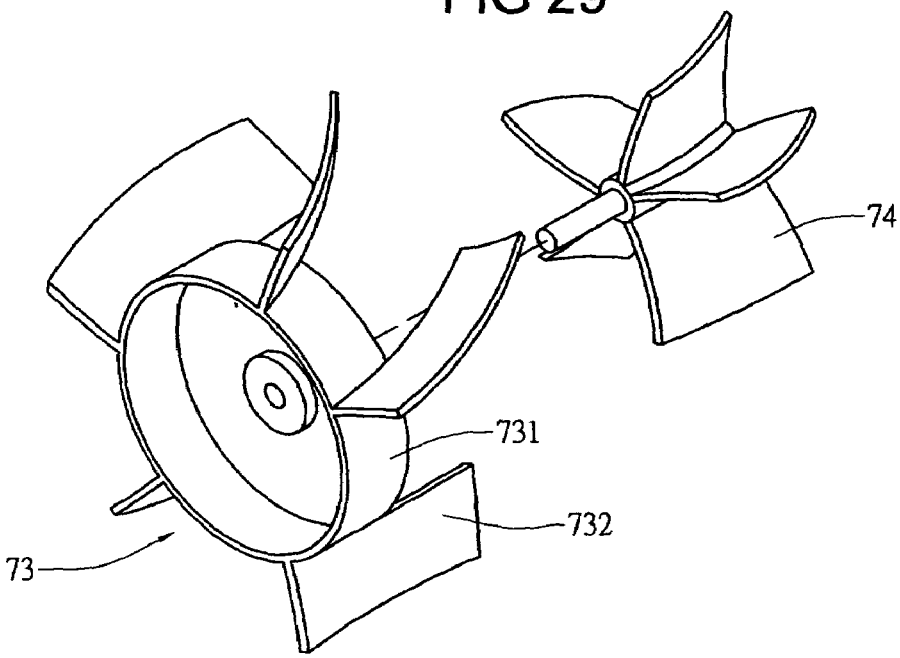
FIG. 29 is an exploded perspective view illustrating the motor rotor and fan blades of the fourth embodiment according to the present invention.
Figure 30:
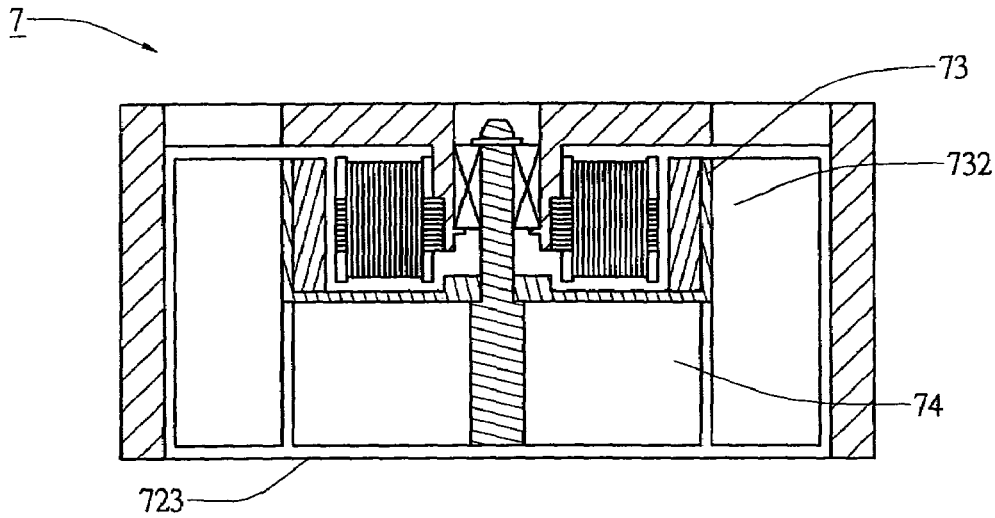
FIG. 30 is a sectional view of the fourth embodiment of a cooling fan according to the present invention.

Referring to FIGS. 29 and 30, the fourth embodiment of the present invention is illustrated. The outer side of the circumferential wall 731 of the rotor 73 is mounted with a plurality of auxiliary fan blades 732 in addition to the fan blade set 74 is axially attached to the rotor 73 such that the airflow moves outward via the outlet 732 of the cooling fan 7 can be increased substantially to enhance effect of heat dissipation.

It is noted that when the fan blade set (55, 64, 74) in the first to fourth embodiments is attached to the entral part (241, 341), the central part (241, 341) can be configured as the shape in the first embodiment and the way of the fan blades (54, 64, 74) joined to the rotor (53, 63, 73) can be the same as that used in the first embodiment.

Figure 31:
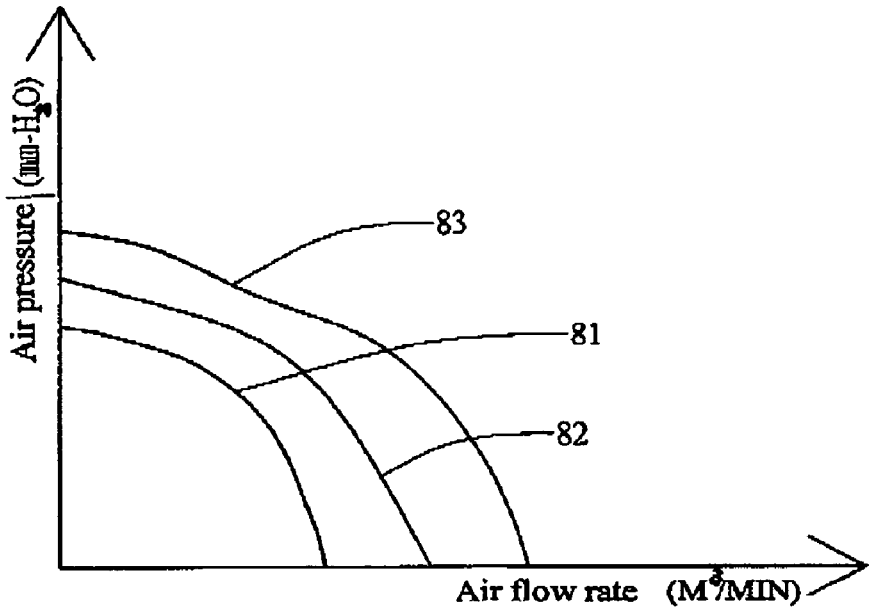
FIG. 31 is a graph illustrating performance curves of the present invention and the prior art.
Figure 32:
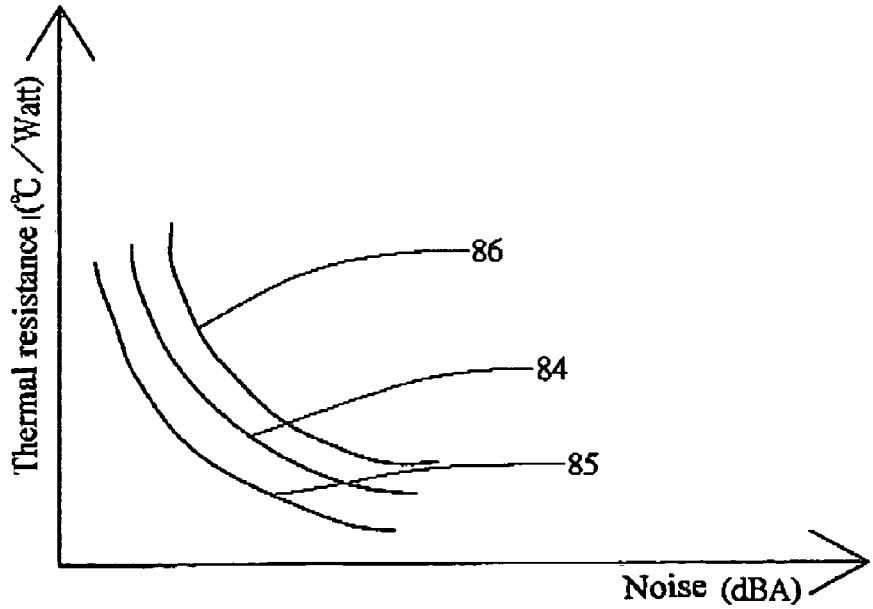
FIG. 32 is a graph illustrating noise and thermal resistance of the present invention and the prior art.

Referring to FIGS. 31 and 32, it can be seen in FIG. 31 that curves 81, 82 are performance curves of the present invention and curve 83 is performance curve of the conventional fan. Specifically, the curve 82 is performance curve of the fourth embodiment of the present invention. Curves 84, 85 shown in FIG. 32 illustrate noise in relation with thermal resistance of the present invention and curve 86 illustrates noise in relation with thermal resistance of the conventional fan. Specifically, curve 85 is a relation curve of the fourth embodiment of the present invention. It can be understood from the two figures that thermal resistance of the present invention is less than that of the conventional fan under the same noise level in spite of the present invention providing lower performance characteristics. Especially, the fourth embodiment has a preferable performance curve and provides the least thermal resistance under the same noise level. Therefore, it is appreciated that the curves in FIGS. 31 and 32 further explain the present invention provides much better effect of heat dissipation than the conventional cooling fan.

While the invention has been described with referencing to preferred embodiments thereof, it is to be understood that modifications or variations may be easily made without departing from the spirit of this invention, which is defined by the appended claims.

What is claimed is:

1. A cooling fan without returning flow comprising:

a motor stator being a disk with a bearing sleeve extending from the center of the disk to receive and support a bearing and a coil being disposed to surround the bearing sleeve;

a frame with an inlet side and an outlet having a hollow space and being joined to the stator at the inlet side with a support device; and a motor rotor being disposed at the inlet side to face the stator, having a channel shaped cross section with an open side and a closed side for receiving the bearing sleeve and the coil, and providing an inner circumferential wall surface for being attached to a ring shaped magnet;

characterized in that an accommodating space is formed between the stator and the inlet side for receiving the rotor and a fan blade set with a plurality of fan blades is integrally joined to the closed side of the rotor laterally such that the fan blade set is disposed in the hollow space of the frame and both of the stator and the rotor are disposed outside the inlet side of the frame;

whereby, when the fan runs, airflow is capable of moving outward smoothly via the outlet side without producing a stagnation zone at the outlet side for enhancing the effect of heat dissipation and attenuating sound level of noise.

2. The cooling fan without returning flow as defined in claim 1, wherein the fan blade set has a central part fixedly attached to a lateral side of a respective fan blade and the central part extends a shaft section to be joined to the enter of the closed side of the rotor and fit with the bearing in the bearing sleeve.

3. The cooling fan without returning flow as defined in claim 2, wherein the central part is provided with a shape of a stem.

4. The cooling fan without returning flow as defined in claim 2, wherein the central part is provided with a shape of of a cone and the tip of the cone is disposed at the outlet side of the frame.

5. The cooling fan without returning flow as defined in claim 2, wherein the central part has a shape of a truncated cone with a flat top of the cone being disposed at the outlet side of the frame.

6. The cooling fan without returning flow as defined in claim 2, wherein the shaft section is arranged to have a tapering secured piece for securing to the rotor.

7. A cooling fan without returning flow comprising:

a motor stator being a disk with a bearing sleeve extending from the center of the disk to receive and support a bearing and having a coil being disposed to surround the bearing sleeve;

a frame with an inlet side and an outlet side having a hollow space and being joined to the stator with a support divide, which has a plurality of radial locating bars with an end of a respective radial locating bar fixing to the stator and another end of the respective radial locating bar fixing to a circumferential wall surface of the hollow space; and a motor rotor being disposed in the hollow space next to the stator, having a channel shaped cross section with a circumferential wall, an open side and a closed side for receiving the bearing sleeve and the coil, and the inner side of the circumferential wall being attached with a ring shaped magnet;

characterized in that the stator and the rotor are disposed in the hollow space next to the inlet side; a fan blade set with a plurality of fan blades is integrally joined to the closed side of the rotor laterally to be disposed in the hollow space of the frame next to the outlet side; and a plurality of auxiliary fan blades are mounted to the the rotor in a way of a lateral side of a respective auxiliary fan blade being fixedly attached to the circumferential wall of the rotor and extending to the outlet side next to the fan blade set;

whereby, when the fan runs, airflow is capable of moving outward smoothly via the outlet side without producing a stagnation zone at the outlet side for enhancing the effect of heat dissipation and attenuating sound level of noise.

8. The cooling fan without returning flow as defined in claim 7, wherein the fan blade set has a central part fixedly attached to a lateral side of a respective fan blade and the central part extends a shaft section to be joined to the center of the closed side of the rotor and fit with the bearing in the bearing sleeve.

9. The cooling fan without returning flow as defined in claim 8, wherein the central part is provided with a shape of a stem.

10. The cooling fan without returning flow as defined in claim 8, wherein the central part is provided with a shape of a cone and the tip of the cone is disposed at the outlet side of the frame.

11. The cooling fan without returning flow as defined in claim 8, wherein the central part has a shape of a truncated cone with a flat top being disposed at the outlet side of the frame.

12. The cooling fan without returning flow as defined in claim 7, wherein the shaft section is arranged to have a tapered securing piece for securing to the rotor.

13. The cooling fan without returning flow as defined in claim 7, wherein each of the radial locating bars is positioned slantwise with an end fixedly attached to the stator and another end fixedly attached to the inlet side of frame.

* * * * *